US005086682A

United States Patent [19]

Strub et al.

[11] Patent Number: 5,086,682

[45] Date of Patent: * Feb. 11, 1992

[54] BAND CUTTING APPARATUS

[76] Inventors: Eric W. Strub, 235 Rockhill Rd., Vista, Calif. 92084; Kenneth M. Strub, 25670 Jesmond Dene, Escondido, Calif. 92026

[ * ] Notice: The portion of the term of this patent subsequent to Apr. 10, 2007 has been disclaimed.

[21] Appl. No.: 505,241

[22] Filed: Apr. 5, 1990

[51] Int. Cl.[5] ..... B26D 5/08; B65B 9/10

[52] U.S. Cl. ..... 83/382; 53/292; 53/293; 53/297; 83/578; 83/614; 83/935

[58] Field of Search ..... 83/578, 613, 614, 935, 83/282, 382, 383; 53/567, 585, 557, 292, 293, 297

[56] References Cited

U.S. PATENT DOCUMENTS

| | | | |
|---|---|---|---|
| 3,802,152 | 4/1974 | Strub | 53/64 |
| 4,329,896 | 5/1982 | Singer | 83/578 X |
| 4,545,181 | 10/1985 | Frankefort | 53/459 |
| 4,754,674 | 7/1988 | Perlman | 83/614 X |
| 4,914,893 | 4/1990 | Strub et al. | 53/292 X |
| 4,922,683 | 5/1990 | Connolly | 53/585 X |

FOREIGN PATENT DOCUMENTS

| | | |
|---|---|---|
| 886435 | 1/1962 | United Kingdom . |
| 1322262 | 7/1973 | United Kingdom . |
| 1359580 | 7/1974 | United Kingdom . |
| 1499558 | 2/1978 | United Kingdom . |
| 1582122 | 12/1980 | United Kingdom . |
| 1591086 | 6/1981 | United Kingdom . |

*Primary Examiner*—Mark Rosenbaum
*Assistant Examiner*—Kenneth E. Peterson
*Attorney, Agent, or Firm*—Brown, Martin Haller & McClain

[57] ABSTRACT

A cutting apparatus for cutting tubular banding material in a banding machine includes as guide assembly for guiding tubular banding material in a flattened condition along a guide path from an inlet end to a cutting station, and a single cutting blade mounted for movement in a transverse cutting path across the flattened material at the cutting station. A pinch mechanism is provided for pinching opposite sides of the flattened material together immediately adjacent the cutting station to hold the material securely against bunching up while it is being cut.

9 Claims, 2 Drawing Sheets

BAND CUTTING APPARATUS

BACKGROUND OF THE INVENTION

1. Field of the Invention

The present invention relates generally to banding machines for placing bands on containers, and is particularly directed to an apparatus for use in such machines for cutting banding material into predetermined length bands prior to their placement on a container neck.

2. Description of Related Art

Prior cutting devices for cutting continuous tubular banding material to predetermined length bands have utilized two blades between which the material is fed and which travel across one another to cut the material in a shearing or scissors-like action. This type of device is subject to some disadvantages, in that it is difficult, if not impossible, to make a straight cut if the banding material is of large diameter, and the ends of the cut material will tend to stick together, making it very difficult to open out the band for placement over a container neck. Additionally, the cut edges will tend to be uneven, due to bunching of the material, and the device does not cut well, particularly with large diameter banding material.

SUMMARY OF THE INVENTION

It is an object of this invention to provide a new and improved cutting apparatus for banding machines and the like.

According to the present invention, a band cutting apparatus is provided which has an elongate slot at an inlet end of the apparatus for guiding tubular banding material into the apparatus, a guide extending from the slot towards a cutting station for guiding banding material in a generally flattened condition to the cutting station, a pinch mechanism at the cutting station for pinching opposite sides of the flattened material together, and a single cutting blade at the cutting station moveable in a transverse path across the width of the flattened band, with a drive mechanism for driving the cutting blade back and forth along the path to cut successive bands from the banding material.

This apparatus allows banding material of any diameter to be cut effectively and accurately into predetermined length bands. Instead of two cutting blades acting together in a shearing action, this apparatus uses a single blade which traverses across the width of the material to be cut, while the pinch mechanism holds the material in place at the cutting station to avoid any bunching up of the material as the cutter blade pushes through it.

Preferably, the guide means comprises a pair of plates extending parallel to one another from the inlet slot at a predetermined spacing, at least one of the plates being of resilient material, while the pinch mechanism comprises a biassing mechanism at the end of the plates remote from the inlet slot for urging the plates against one another at their ends adjacent the cutting station, so that banding material travelling between the plates will be pinched together at the cutting station, holding the material against bunching up while it is being cut by the single cutting blade. In a preferred embodiment of the invention, the drive mechanism is of a cable or pulley type similar to that used in a typewriter, with the cutting blade being supported on a carriage which is itself supported on a guide rod, and which is connected to a pulley driven cable. The drive motor rotates the pulley drive to wind the cable on or off a pulley drive wheel, depending on the direction of travel, at the same time pulling the carriage back and forth along the guide rod. Preferably, the pinch mechanism is also mounted on the travelling carriage and may comprise biassing rollers located on opposite sides of the cutting blade, so that the region immediately in front of the area being cut is held securely against bunching. The cutter blade drive motor is activated in response to a predetermined length of banding material being fed through the apparatus and the detection of a container present at a band depositing station immediately following the cutting apparatus.

This apparatus allows bands of any diameter, from ten inches to ten feet or more, to be cut accurately and effectively with little or no bunching up of the material. It also reduces wear on the cutter blade over conventional cutting devices using two blades, since the single blade does not contact any other metal device but only the material of the band, and reduces the problems of cut edges sticking together and making it difficult to open out the band prior to placement on a container. Thus, bands for placing on any size containers can be cut using this apparatus.

BRIEF DESCRIPTION OF THE DRAWINGS

The present invention will be better understood from the following detailed description of a preferred embodiment of the invention, taken in conjunction with the accompanying drawings, in which like reference numerals refer to like parts and in which.

DESCRIPTION OF THE PREFERRED EMBODIMENT

Figure 1:
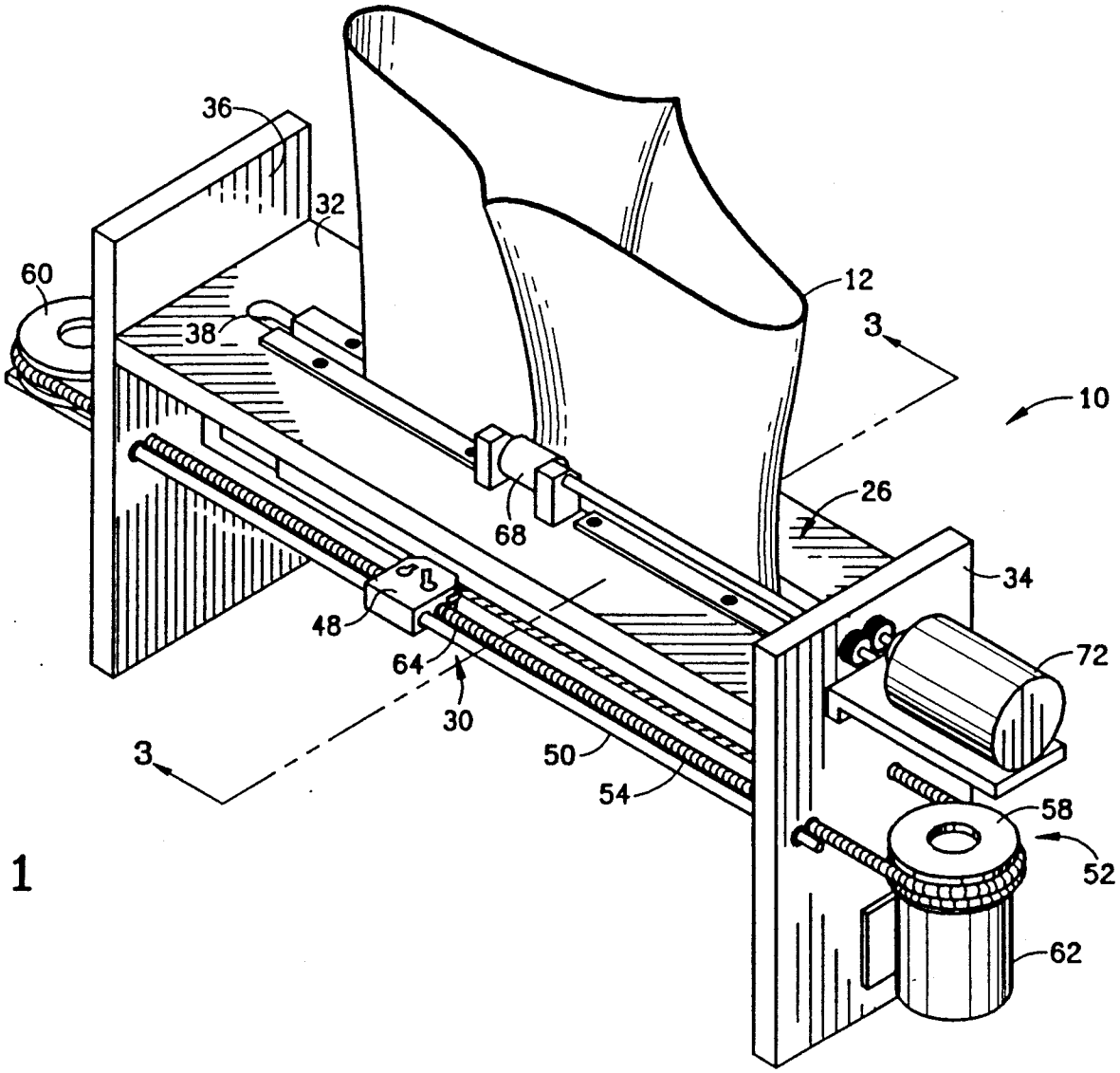
FIG. 1 is a perspective view of a band cutting apparatus according to a preferred embodiment of the invention.
Figure 3:
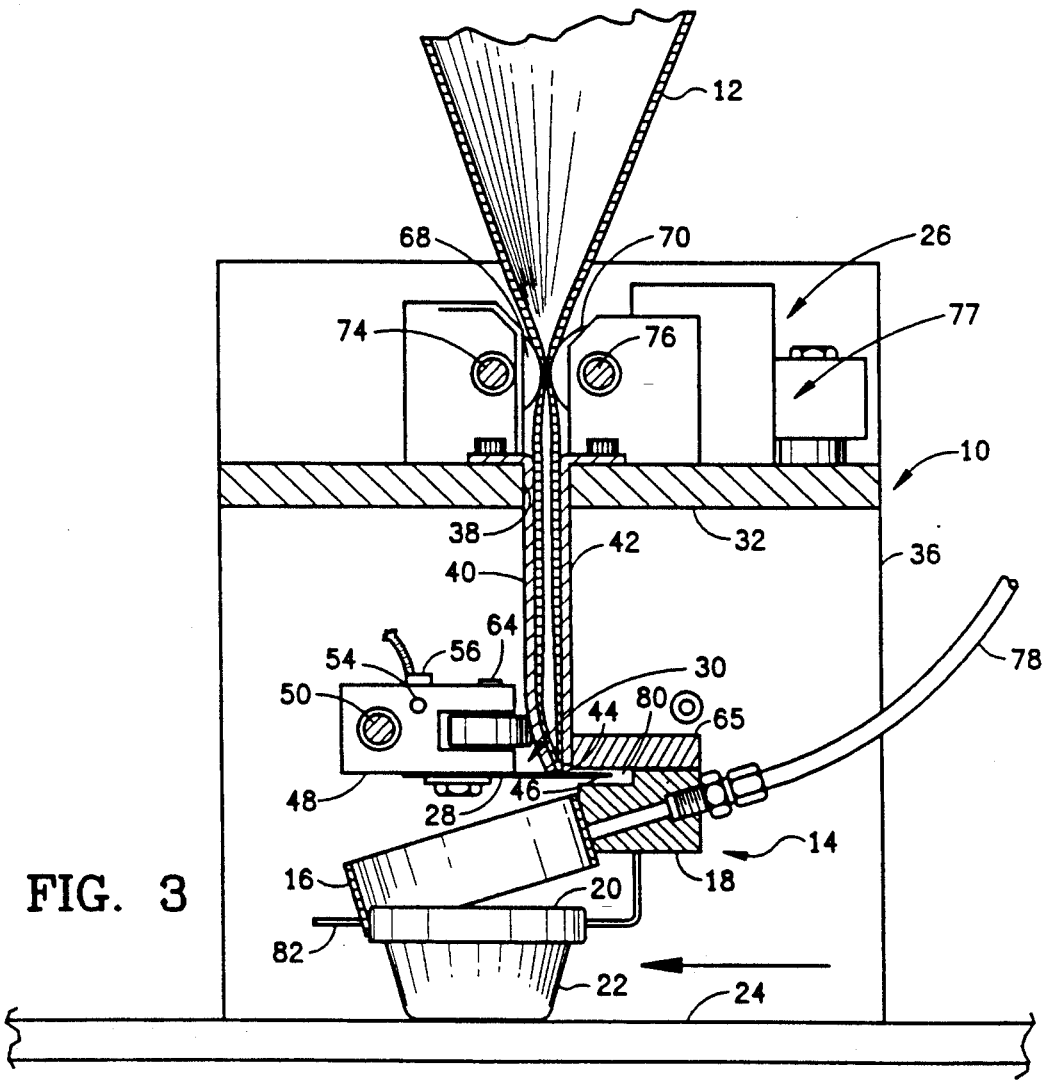
FIG. 3 is a section on the lines 3—3 of FIG. illustrating the cutting apparatus and the next subsequent station in a banding machine in which the apparatus is used.

FIG. 1 of the drawings illustrates a band cutting apparatus 10 according to a preferred embodiment of the present invention for cutting tubular banding material 12 to predetermined lengths. The apparatus is particularly suitable for use in a banding machine of the type used for mounting cut bands on the necks of container for sealing purposes. Such machines are described, for example, in U.S. Pat. No. 3,802,152 of Strub, entitled "Banding Apparatus", and in our copending application Ser. No. 07/160,848 filed Feb. 26, 1988 now U.S. Pat. No. 4,914,893 entitled "Large Size Container Bander". These banding machines use cutting devices to cut banding material to a predetermined length prior to positioning the cut bands on a container neck and sealing them around the neck. The cutting apparatus of this invention can replace conventional cutting devices in these and other banding machines, and FIG. 3 illustrates the apparatus 10 positioned immediately prior to the band deposition station 14 of a banding machine, so that bands 16 cut by the apparatus 10 are held at one side by vacuum head 18 while they are deposited on the neck or upper end 20 of a container 22 carried beneath the deposition station by a suitable transporting or conveyor mechanism 24. In the embodiment illustrated in FIG. 3, the cutting apparatus is illustrated installed prior to the deposition station of a banding apparatus as described in our co-pending application Ser. No. 07/160,848 referred to above. However, it can alternatively be installed on any banding machine prior to its deposition station in a similar manner, or in any machine in which tubular material has to be cut to length.

Figure 2:
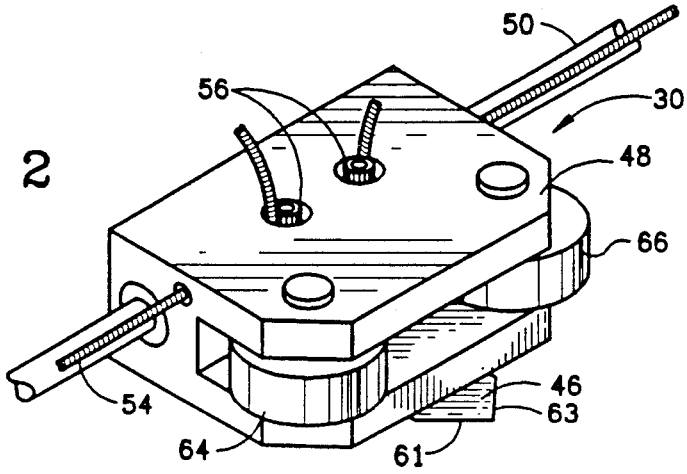
FIG. 2 is a perspective view of the cutter blade and carriage of the apparatus of FIG. 1, on an enlarged scale.

The banding apparatus illustrated in FIGS. 1 to 3 will now be described in more detail. The apparatus basically includes a guide assembly 26 for guiding tubular banding material in a flattened condition to a cutting station 28 where a cutting mechanism 30 is mounted for movement in a path which traverses across the banding material to cut off the end of the material projecting from the cutting station into a band 16 of predetermined height. The guide assembly comprises a horizontal guide plate 32 supported between end plates 34,36 and having an elongate inlet slot 38 of length greater than the banding material diameter for guiding banding material in a flattened condition into the apparatus. Opposing plates 40,42 project downwardly from the slot to guide the flattened banding material to the cutting station 28 which is located immediately below the lowermost or outlet ends 44 of the guide plates 40,42. At least one of the plates 40 is of resilient or springy material.

The cutting mechanism comprises a single cutter blade 46 mounted on a carriage 48 which is itself slidably mounted on a guide rod 50 extending between the end plates 34 and 36. The carriage is driven back and forth along the guide rod by a pulley driven cable drive mechanism 52. The drive mechanism 52 comprises a cable 54 to which the carriage is secured at opposite ends via fasteners 56, and which extends around a first, drive roller 58 at one end of the apparatus and a second, idler or freely rotable roller 60 rotatably mounted on the outer face of the end plate 36 at the opposite end of the apparatus. The drive roller 58 is driven by reversible stepper motor 62 which is mounted on the outer face of the other end plate 34, as best illustrated in FIG. 1. Rotation of roller 58 in a clockwise direction will cause the carriage to travel from right to left across the cutter station, while rotation in the opposite direction will cause it to travel back from the left hand end to the right hand end of the apparatus. As best seen in FIG. 2, the cutting blade 46 is a flat blade projecting from the carriage 48 across the outlet end of the plates 40 and 42. The blade has oppositely directed cutting edges 61,63 so that material can be cut by the blade in both directions of travel of the carriage, reducing time and expense in operation since the blade does not have to be returned to the same start position after each cutting operation.

Biassing or pinch rollers 64,66 are rotatably mounted on the carriage 48 on opposite sides of blade 46 and at a position spaced above it, as best seen in FIG. 3. These rollers are arranged to bias the spring plate 40 at its lower end towards the other plate 42, which is supported against a rigid support member 65, to close up the gap at the outlet end 44 of the guide plates and to pinch the banding material together at this point, as best illustrated in FIG. 3, so that it will be held securely while being cut. Since the rollers 64 and 66 are located on opposite sides of the blade 46, the material immediately in front of the cutter blade will always be pinched or held securely, whichever direction the blade is driven. The biassed plate 40 is urged to curve inwardly towards the opposite plate 42 at its lower end, closing the gap between the plates and pinching the banding material between the ends of the plates.

Opposed inlet feed rollers 68,70 are mounted at the inlet end of the apparatus immediately above inlet slot 38. These are both driven via drive motor 72 connected to drive rods 74,76 on which the respective rollers are mounted. Drive motor 72 is mounted on the outer face of end plate 34, as illustrated in FIG. 1. The rollers 68,70 act both to pinch the banding material flat at the inlet and to transport the material into the cutting apparatus. Feed rollers 68,70 may be replaced with other conventional drive mechanisms, if desired. A suitable retraction mechanism 77 of a known type is provided for retracting one of the rollers when a new roll of banding material is to be loaded.

As illustrated in FIG. 3, the cutting apparatus is positioned immediately above deposition station 14, which may also be supported on end walls 36,38 in a suitable fashion. The vacuum nozzle or head 18 is secured by hose 78 to a vacuum pump, and is positioned as illustrated in FIG. 3 immediately beneath the cutting station 28 so that banding material cut into a band 16 can immediately be picked up by the head 18 by switching on the vacuum pump at the appropriate time. As illustrated in FIG. 3, if necessary a slot 80 may be cut out in head 18 to receive the outermost end of the cutting blade so that it can travel freely across the upper end of the vacuum head.

Operation of the drive motors 62 and 72 and the vacuum head 18 will be suitably synchronized with the arrival of a container 22 below the deposition station 14. An overall system controller for controlling of all the elements of a banding machine, for example as described in our co-pending application Ser. No. 07/160,848, the contents of which are incorporated herein by reference, may be suitably modified in order to operate the motors 62,72 in the desired manner. As in that system, the presence of a container at the deposition station is detected by a suitable sensor or switch mechanism. Prior to this, a predetermined amount of banding material will have been fed through the cutting apparatus by drive rollers 68 and 70, the motor 72 being switched off when the rollers have been turned a designated amount, at which point a desired amount of material projects from the cutting station. At this point, a signal from the driver of motor 72 will operate to activate motor 62 to drive the carriage in a first direction across the cutting path, and vacuum head 18 is switched on to support one side of the cut band. The opposite side of the band is supported at the desired height by suitable L-shaped support brackets 82, as indicated in FIG. 3. Once the carriage reaches the opposite end of its path, which may be determined by timing or in any other suitable manner, motor 62 is switched off. As a container 22 is positioned beneath newly formed band 16, the vacuum supply is cut off, releasing suction on the band 16 which then falls loosely around the container. It is then transferred to the next station of the apparatus for heat sealing onto the container neck. At the same time, motor 72 is again activated to feed a predetermined amount of material, switched off, and motor 62 is driven in the opposite direction to drive the cutting blade back across the path to cut the next subsequent band of material, the vacuum head being activated to support the band. Thus, the cutter does not have to be returned to a start position at the end of each cutting operation.

The pinch or biassing rollers 64 and 66 act to hold the banding material securely while it is being cut, by biassing plate 40 against plate 42 at their lower ends to pinch the banding material between the ends of the plates 40 and 42 as it is being cut, so that any tendency for the material to bunch up as it is cut is resisted. This is a particular advantage when cutting banding material of large diameter, when bunching up is a significant problem, and allows the single cutting blade to make a substantially straight cut edge across the banding material, making a more uniform and appealing end product.

The use of the biassing rollers also allows a single cutting blade to be used to cut the banding material, rather than opposed cutting blades which act in a shearing fashion, and this reduces wear on the cutting blade, giving it a longer operating lifetime. Additionally, banding material of any diameter can be cut accurately and effectively. The slot 38 can be made long enough to accommodate the largest diameter banding material to be used in a banding machine, or inlet guide mechanisms having inlet slots of various lengths may be provided in order to accommodate a range of banding material diameters from relatively small up to the largest diameter used in the field.

Although a preferred embodiment of the invention has been described above by way of example only, it will be understood by those skilled in the field that modifications may be made to the disclosed embodiment without departing from the scope of the invention, which is defined by the appended claims.

We claim:

1. A band cutting apparatus for cutting banding material to form separate bands of predetermined height for placing around container necks, the apparatus comprising:

guide means for guiding banding material in a flattened condition along a predetermined guide path from an inlet towards a cutting station;

pinch means for pinching opposite sides of the flattened banding material together in a region to be cut at said cutting station;

a single cutter blade mounted at said cutting station adjacent said pinch means for movement in a cutting path across the pinched and flattened banding material at the cutting station to cut a band of predetermined length from the material; and transport means for transporting said blade and said pinch means together back and forth across said cutting path.

2. The apparatus as claim 1, wherein said guide means has an elongate inlet slot defining the inlet end of said guide path, and a pair of opposed parallel guide plates extending from said inlet slot towards said cutting station.

3. A band cutting apparatus for cutting banding material to form separate bands of predetermined height for placing around container necks, the apparatus comprising:

guide means for guiding banding material in a flattened condition along a predetermined path from and inlet towards a cutting station, the guide means having an elongate inlet slot defining the inlet end of said guide path, and a pair of opposed parallel guide plates extending from said inlet slot towards said cutting station;

pinch means at said cutting station for pinching opposite sides of the flattened banding material together in a region to be cut;

at least one of said guide plates comprising a resilient plate and said pinch means comprising means for biassing an end of said resilient plate remote from said inlet slot towards an end of the other guide plate to pinch material between the ends of the two guide plates;

a single cutter blade mounted for movement in a transverse cutting path across the pinched and flattened banding material at the cutting station to cut a band of predetermined length from the material; and transport means for transporting said blade back and forth along said cutting path.

4. The apparatus as claimed in claim 3, wherein said transport means comprises a carriage, support means for supporting said carriage for movement back and forth along said cutting path, and reversible drive means for driving said carriage across said path, and said blade is mounted on said carriage and projects from said carriage across an outlet end of said guide means.

5. The apparatus as claimed in claim 4, wherein said pinch means is mounted on said carriage.

6. The apparatus as claimed in claim 4, wherein said cutting blade has cutting edges facing in opposite directions in alignment with said cutting path for cutting material in both directions of travel of said blade.

7. The apparatus as claimed in claim 6, wherein said pinch means comprises a pair of pinch rollers rotatably mounted on said carriage immediately above said cutting blade to project into said guide path and located on opposite sides of said cutting edges.

8. The apparatus as claimed in claim 7, wherein said guide means includes a pair of opposed parallel plates, at least one of said plates being of resilient material, and said pinch rollers comprise means for bearing against the resilient plate adjacent the outlet end of said guide path to urge it towards the opposing plate at least in the regions of the cutting path on opposite sides of said cutting blade.

9. A band cutting apparatus for cutting banding material to form separate bands of predetermined height for placing around container necks, the apparatus comprising:

guide means for guiding banding material in a flattened condition along a predetermined guide path from an inlet towards a cutting station;

pinch means at said cutting station for pinching opposite sides of the flattened banding material together in a region to be cut;

a single cutter blade mounted for movement in a cutting path extending along and parallel to the flattened opposite sides of the pinched and flattened banding material at the cutting station to cut a band of predetermined length from the material;

transport means for transporting said blade back and forth along the width of said flattened banding material;

feed means for driving a predetermined amount of material along said guide path in a feed step; and control means for activating said cutter transport means to cut off the projecting end of material on completion of said feed step.

* * * * *